US006765341B2

(12) United States Patent
Bae

(10) Patent No.: US 6,765,341 B2
(45) Date of Patent: Jul. 20, 2004

(54) FAN HAVING DUST-PROOF APPARATUS

(75) Inventor: Young-Jin Bae, Daegu (KR)

(73) Assignee: LG Electronics Inc. (KR)

( * ) Notice: Subject to any disclaimer, the term of this patent is extended or adjusted under 35 U.S.C. 154(b) by 60 days.

(21) Appl. No.: 10/122,038

(22) Filed: Apr. 11, 2002

(65) Prior Publication Data

US 2003/0044271 A1 Mar. 6, 2003

(30) Foreign Application Priority Data

Aug. 31, 2001 (KR) ..... 2001-53427

(51) Int. Cl.[7] ..... H01J 61/10
(52) U.S. Cl. ..... 313/231.31; 315/248
(58) Field of Search ..... 315/248, 39, 111.21, 315/111.81; 313/231.31, 231.61, 234, 246, 248, 568, 570, 607

(56) References Cited

U.S. PATENT DOCUMENTS 4,889,543 A 12/1989 Burt ..... 55/97
5,494,006 A 2/1996 Davis, Jr. ..... 123/41.49
6,486,594 B1 * 11/2002 Kang ..... 313/231.31

FOREIGN PATENT DOCUMENTS

GB 2356972 6/2001
JP 2000-161734 * 6/2000 ..... F24F/7/04

OTHER PUBLICATIONS

Office Action issued from corresponding Swedish Application No. 020116–1, including translation thereof.

* cited by examiner

*Primary Examiner*—James Clinger
*Assistant Examiner*—Chuc Tran
(74) *Attorney, Agent, or Firm*—Ostrolenk, Faber, Gerb & Soffen, LLP

(57) ABSTRACT

A fan having a dust-proof apparatus includes: a casing having a passage; a rotation driving unit installed inside the casing; a plurality of blades positioned in the passage and coupled to a rotational shaft of the rotation driving unit so as to be rotated; and a dust-proof member installed at an entrance of the passage to cover the entrance of the passage, and integrally coupled to the blades so as to be rotated together with the blades. Since insects or big dusts can be prevented from being introduced according to an air flowing generated as the blades are rotated, and the coupling state between parts is firm. In addition, since the eccentricity is minimized, the parts are not damaged, and as a noise generation is restrained, so that reliability can be heightened.

12 Claims, 9 Drawing Sheets

FAN HAVING DUST-PROOF APPARATUS

BACKGROUND OF THE INVENTION

1. Field of the Invention

The present invention relates to a fan, and more particularly, to a fan having a dust-proof apparatus installed at a suction hole thereof that is capable of preventing insects or dust from being introduced together with air.

2. Description of the Background Art

A fan generating fluid flow such as air flow typically includes a casing having an air flow passage; a drive motor mounted inside the casing and generating a rotational force; and a plurality of blades rotatably installed in the air flow passage of the casing and being rotated upon receipt of a driving force of the drive motor.

In the fan, when the drive motor is operated as a power is applied thereto, the blades are rotated according to the drive motor.

When the blades are rotated, a pressure difference is generated due to the rotation of the blades, and thanks to the pressure difference, air flows along the air flow passage.

The fan is classified into an axial flow fan, a centrifugal fan and a sirocco fan according to air flow passage form.

In case of the axial flow fan, air flow forms a linear flow as air is introduced from a front side and flows to a back side. Meanwhile, in case of the centrifugal fan or the sirocco fan, it forms a curved flow as air is introduced from the front side and flows out to the side.

A fan is used in various fields where the air flowing is required, and an electrodeless lighting system employs it to cool devices installed therein by sucking air from outside.

FIG. 1 is a sectional view showing an electrodeless lighting system having a fan with a dust-proof apparatus.

As shown in FIG. 1, the electrodeless lighting system having a fan with a dust-proof apparatus includes: a casing 10; a high voltage generator 20 mounted at an inner front surface of the casing 10 and generating a high voltage; an microwave generator 30 for generating a microwave with the high voltage generated from the high voltage generator 20; a wave guide 40 for guiding the microwave generated from the microwave generator 30 and serving as a first resonator; a second resonator 50 installed at a front outer side of the casing 10, exciting the microwave guided through the waveguide 40 and generating a strong electric field; an electrodeless lamp 60 rotatably mounted inside the second resonator 50, forming a plasma as a gas filled therein is excited according to the strong electric field of the second resonator 50, to thereby generate a light; a first mirror 70 positioned at a rear face of the electrodeless lamp 60 and reflecting the light generated from the electrodeless lamp 60 to the front surface; and a second mirror 80 for collecting the light generated from the first mirror 70 and the electrodeless lamp 60 and reflecting it to the front side.

The casing 10 includes a lamp driving motor 90 for rotating the electrodeless lamp 60 to cool the electrodeless lamp 60 and a connection shaft 91 for connecting the lamp driving motor 90 and the electrodeless lamp 60.

At one side of the casing 10, a passage 11 is installed allowing air to flow toward the microwave generator 30 and the high voltage generator 20. An entrance 12 is formed at one side of the passage 11, into which an external air is introduced, and a fan 100 is mounted at the inner side of the entrance 12.

The fan 100 includes a plurality of blades 101 for generating air flowing by rotation and a fan driving motor 110 for rotating the blades 101.

The operation of the electrodeless lighting system will now be described.

First, when a power is applied to the high voltage generator 20, the high voltage generator 20 generates a high voltage, and the microwave generator 30 generates microwave according to the high voltage generated from the high voltage generator 20.

The microwave generated from the microwave generator 30 is transferred to the second resonator 50 through the wave guide 40, so that a strong electric field is distributed at the second resonator 50, and according to the strong electric field, the substance filled in the electrodeless lamp 60 is discharged, and at the same time, vaporized to generate plasma.

The light emitted as the plasma is generated from the electrodeless lamp 60 is reflected by the first mirror 70 and the second mirror 80 and illuminated forwardly.

At this time, much heat is generated from the high voltage generator 20 and the microwave generator 30.

The intense heat generated from the electrodeless lamp 60 is cooled by rotating the electrodeless lamp 60 by the lamp driving motor 90.

When the blades 101 are rotated as the fan driving motor 110 is operated, an external air is introduced through the entrance 12 due to the pressure difference according to the rotation of the blades 101.

The external air introduced into the entrance 12 is guided through the passage 11 and flows while passing the high voltage generator 20 and the microwave generator 30 to cool the high voltage generator 20 and the microwave generator 30.

Meanwhile, in the process that the conventional fan 100 having the dust-proof apparatus mounted at the electrodeless lighting system is operated, insects such as a day-fly, mosquito and a moth gather, and the gathered insects and dust are introduced into the passage 11 together with the external air due to the suction force of the fan 100 to be compressed to the fan 100 or attached to a part inside the casing 10, interfering the rotation of the fan 100 or damage the internal parts.

In order to solve the problems, a dust-proof is provided at the side of the entrance 12 where the external air is introduced.

FIG. 2 is an enlarged sectional view of FIG. 1.

As shown in FIG. 2, the dust-proof apparatus of the fan includes a dust-proof member 120, and a screw 130 for engaging the marginal portion of the dust-proof member 120 to the casing 10 so as for the dust-proof member 102 to be fixed.

Though insects or dusts are restrained from being sucked into the casing 10 as they are caught by the dust-proof member 120 in the process that external air is being introduced due to the pressure difference according to the rotation of the blades 101, the conventional fan having the dust-proof apparatus is disadvantages in that insects or dusts are collected at the surface of the dust-proof member 120, causing a reduction of air flowing and increase in an air suction resistance.

FIG. 3 is a vertical-sectional view of a different fan having a dust-proof apparatus, and FIG. 4 is a plan view of the fan having a dust-proof apparatus of FIG. 3.

As shown in FIGS. 3 and 4, Japanese Laid Open Publication No. JP2000161734 discloses another example of the fan having a dust-proof apparatus, in which a guide duct 200 is insertedly fixed at an outdoor opening of a ventilation duct (D), a fixing member 210 having a bearing 211 is insertedly combined inside the guide duct 200, and a propeller 220 rotated by wind is rotatably coupled at the bearing 211 of the fixing member 210.

The cylindrical dust-proof member 230 is fixedly coupled to a rotational shaft 221 of the propeller 220 to cover the front portion of the propeller 220, and a fixing member 240 in a "U" shape having a certain thickness and width traverses the cylindrical dust-proof member 230 and fixedly coupled to one side of the guide duct 200.

In the conventional fan having the dust-proof apparatus having the structure as described above, as the propeller 220 is rotated according to air flowing in the ventilation duct (D), the dust-proof member 230 coupled to the rotational shaft 221 of the propeller 220 is accordingly rotated to thereby prevent insects or dusts from being introduced into the ventilation duct (D) as well as being attached to the dust-proof member 230.

However, since the cylindrical dust-proof member 230 is fixedly coupled to the rotational shaft 221 of the propeller 220, the fixing state of the cylindrical dust-proof member 230 is not firm with the rotational shaft 221.

In addition, an eccentricity is generated between the propeller 220 and the cylindrical dust-proof member 230 coupled to the rotational shaft 221 of the propeller 220 due to an unbalance according to a roundness and assembly precision. Thus, a noise is generated due to the eccentric rotation of the cylindrical dust-proof member, and the coupling state of the dust-proof member would not last long and the coupling is disassembled.

Moreover, since a fixing member 210 is to be additionally installed at an outer side of the ventilation duct (D) to install a bearing that is rotatably supported by the rotational shaft, its structure becomes complicated.

SUMMARY OF THE INVENTION

Therefore, an object of the present invention is to provide a fan having a dust-proof apparatus that is capable of minimizing a noise generation and ensuring a firm coupling state as well as preventing insects or dusts from being introduced according to an air flowing owing to a rotation of a plurality of blades constituting a fan.

To achieve these and other advantages and in accordance with the purpose of the present invention, as embodied and broadly described herein, there is provided a fan having a dust-proof apparatus including: a casing having a passage; a rotation driving unit installed inside the casing; a plurality of blades positioned in the passage and coupled to a rotational shaft of the rotation driving unit so as to be rotated; and a dust-proof member installed at an entrance of the passage to cover the entrance of the passage, and integrally coupled to the blades so as to be rotated together with the blades.

To achieve the above objects, there is also provided a fan having a dust-proof apparatus including: a casing having an entrance and a passage; a rotation driving unit installed inside the casing; a plurality of blades positioned in the passage and coupled to a rotational shaft of the rotation driving unit so as to be rotated; and a dust-proof member installed at an entrance of the passage to cover the entrance of the passage, and coupled to the rotational shaft so as to be rotated together with the blades, wherein an outer circumferential surface of the dust-proof is supported by the entrance so that the dust-proof member is rotatable.

To achieve the above objects, there is also provided a fan having a dust-proof apparatus for an electrodeless lighting system including a casing; a microwave generator mounted inside the casing and generating microwave; a wave guide for guiding the microwave generated from the microwave generator and serving as a first resonator; a second resonator installed outside the casing so as to communicate with the waveguide, and exciting the microwave guided through the waveguide to generate a strong electric field; and an electrodeless lamp mounted inside the second resonator and forming plasma as gas filed inside there is excited by the strong electric field of the second resonator, to thereby generate light, wherein the fan having a dust-proof apparatus includes a passage formed at the casing to suck an external air to cool the electrodeless lighting system; a rotation driving unit installed inside the casing; a plurality of blades installed in the passage and coupled to a rotational shaft of the rotation driving unit so as to be rotated; and a dust-proof member installed at an entrance of the passage to cover the entrance of the passage, and integrally coupled to the blades to be rotated together with the blades.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
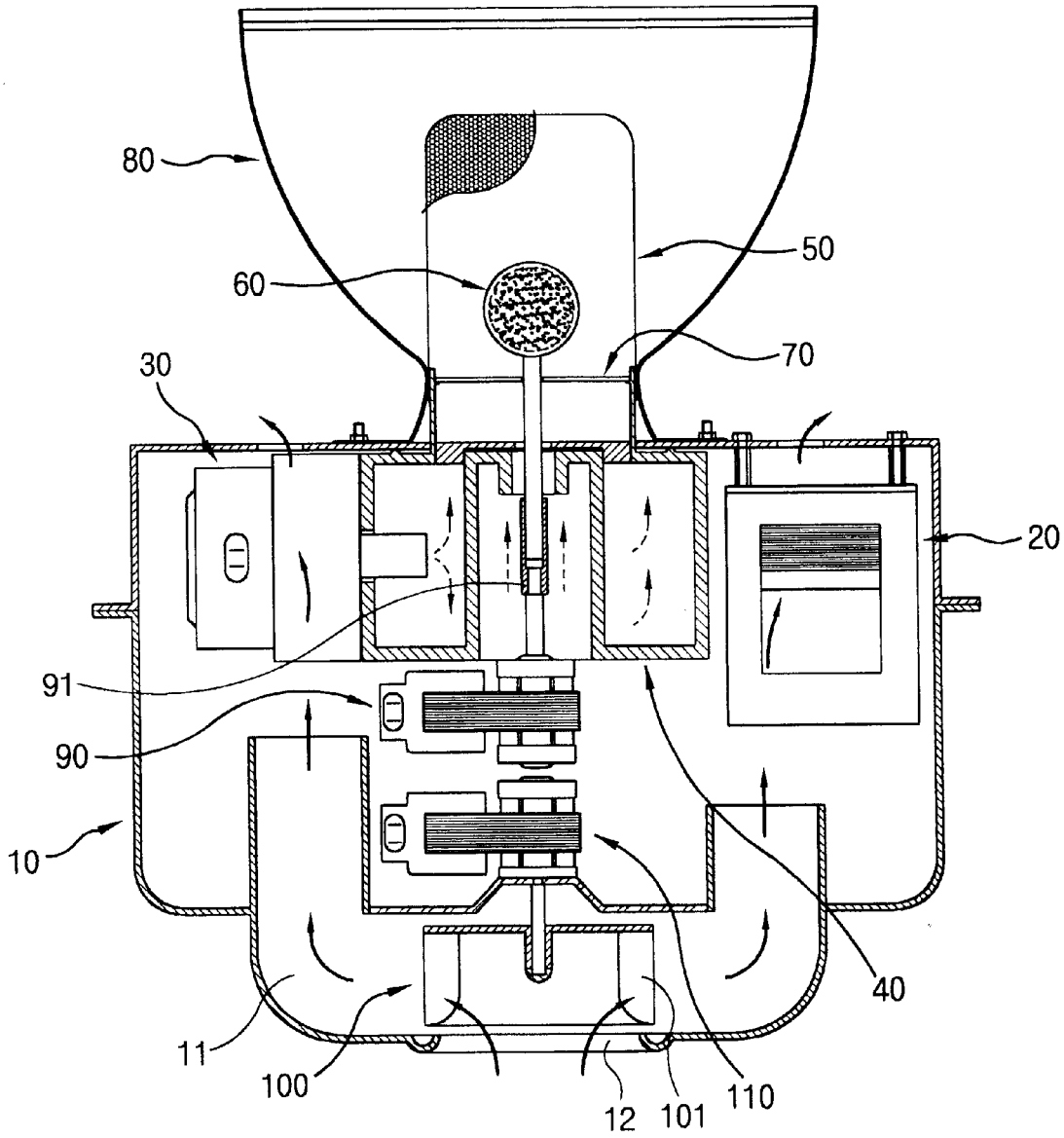
FIG.1 CONVENTIONAL ART
FIG. 1 is a sectional view of an electrodeless lighting system including a fan having a dust-proof apparatus in accordance with a conventional art.
Figure 2:
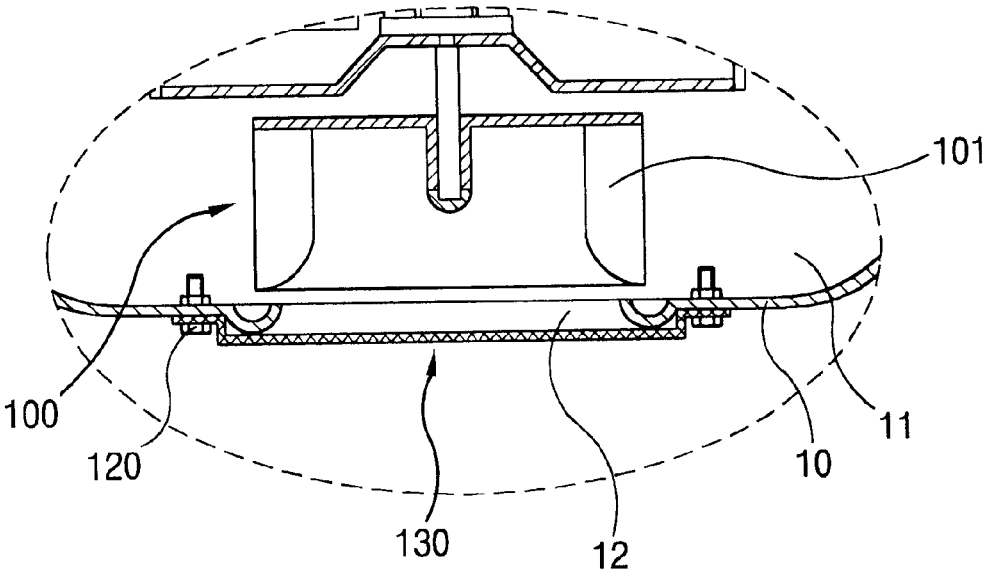
FIG.2 CONVENTIONAL ART
FIG. 2 is an enlarged sectional view of the electrodeless lighting system of FIG. 1 in accordance with the conventional art.
Figure 3:
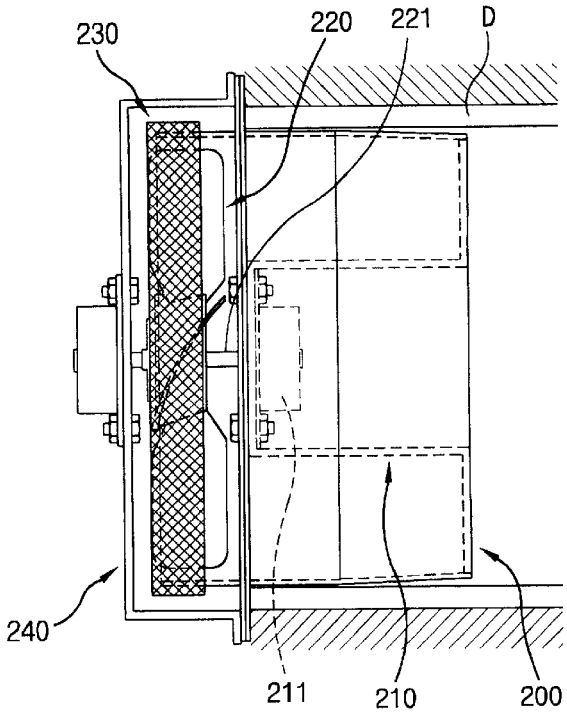
FIG.3 CONVENTIONAL ART
FIG. 3 is a vertical-sectional view of a fan having a different dust-proof apparatus in accordance with a different conventional art.
Figure 4:
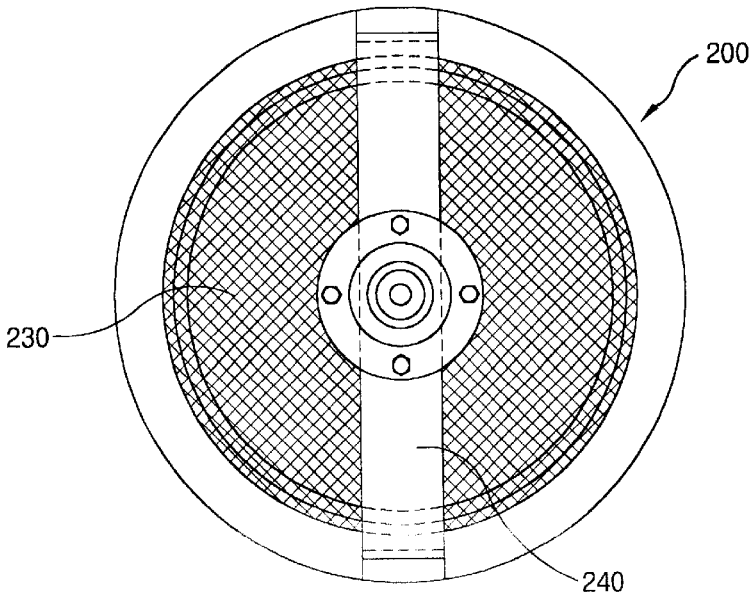
FIG.4 CONVENTIONAL ART
FIG. 4 is a plan view of the fan of FIG. 3 in accordance with the different conventional art.
Figure 5:
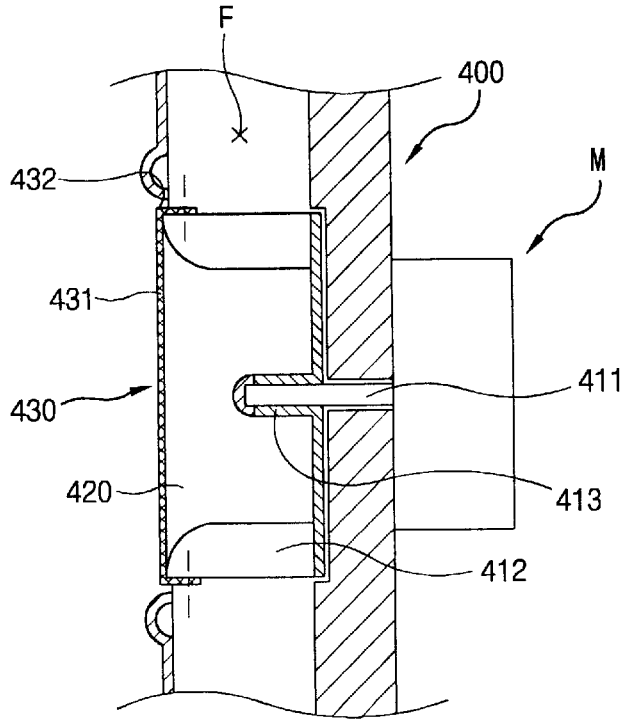
FIG. 5 is a sectional view of a fan having a dust-proof apparatus in accordance with a first embodiment of the present invention.
Figure 6:
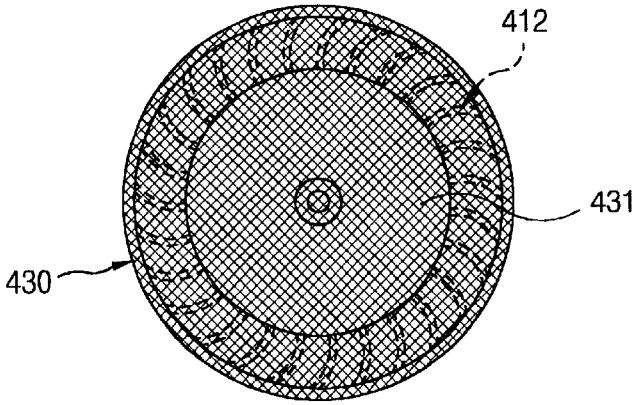
FIG. 6 is a plan view of the fan of FIG. 5 in accordance with the first embodiment of the present invention.

FIG. 5 is a sectional view of a fan having a dust-proof apparatus in accordance with a first embodiment of the present invention, and FIG. 6 is a plan view of the fan of FIG. 5 in accordance with the first embodiment of the present invention.

As shown in FIGS. 5 and 6, a fan having a dust-proof apparatus in accordance with a first embodiment of the present invention includes a casing 400 having a passage (F), a rotation driving unit (M) installed inside the casing 400, a blades 412 positioned in the passage (F) and coupled to a rotational shaft 411 of the rotation driving unit (M) so as to be rotated, and a dust-proof member 430 installed at an entrance 420 of the passage (F) to cover the entrance (420) of the passage (F), and integrally coupled to the blades 412 so as to be rotated together with the blades 412.

The blades 412 are coupled at one side of a hub 413 connected to the rotational shaft 411.

The dust-proof member 430 includes a mesh portion 431 in a disk type having a size corresponding to the size of the entrance 420 of the passage (F), and an outer circumferential portion 432 extended and bent from a marginal portion of the mesh portion 431 and fixed at an end portion of the blades 412.

When the outer circumferential portion 432 of the dust-proof member 430 is fixedly coupled at the end portion of the blades 412, they can be engaged by using an additional engaging unit, which are a screw or bolt and nut.

In the fan having the dust-proof apparatus in accordance with the first embodiment of the present invention, since the dust-proof member 430 is fixedly coupled at the blades 412, that is, fixedly coupled at the margin of the blades 412, the dust-proof member 430 is rotated together with the blades 412. Thus, an eccentricity can be minimized, and as the contact area is wide, the coupling state is firm.

The operation of the fan having the dust-proof apparatus in accordance with the first embodiment of the present invention will now be described.

First, when the rotation driving unit (M) is rotated as a power is applied thereto, the driving force of the rotation driving unit (M) is transferred to the blades 412 connected to the rotational shaft 411, so that the blades 412 are rotated.

As the blades 412 are rotated, the dust-proof member 430 integrally coupled to the blades 412 are accordingly rotated.

According to the rotation of the blades 412, an external air is introduced through the entrance 420 and flows through the passage (F) formed inside the casing 400, that is, the passage (F) perpendicular to the entrance 420, and at this time, since the dust-proof member 420 is also rotated, insects or big dusts introduced into the entrance according to the air flowing collide with the dust-proof member 430 and slip out off therefrom, they are prevented from being introduced into the passage (F).

Figure 7:
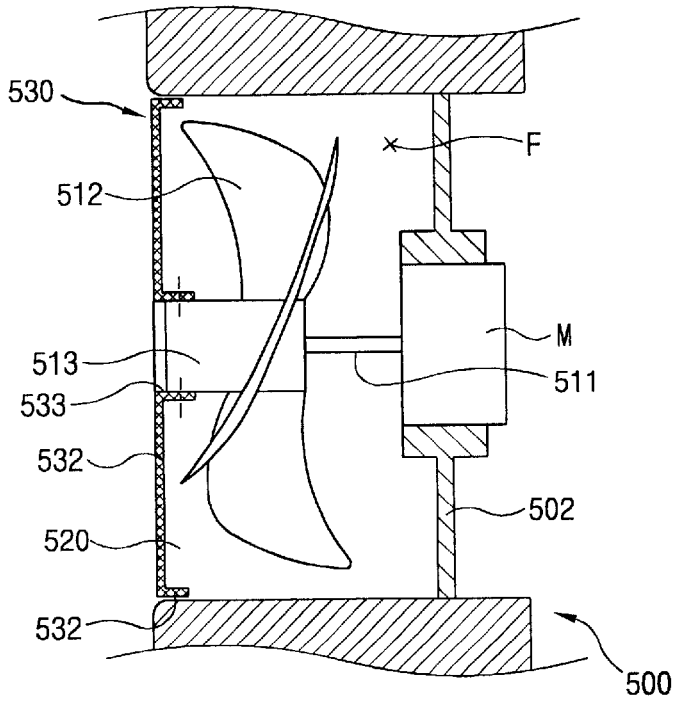
FIG. 7 is a sectional view of a fan having a dust-proof apparatus in accordance with a second embodiment of the present invention.
Figure 8:
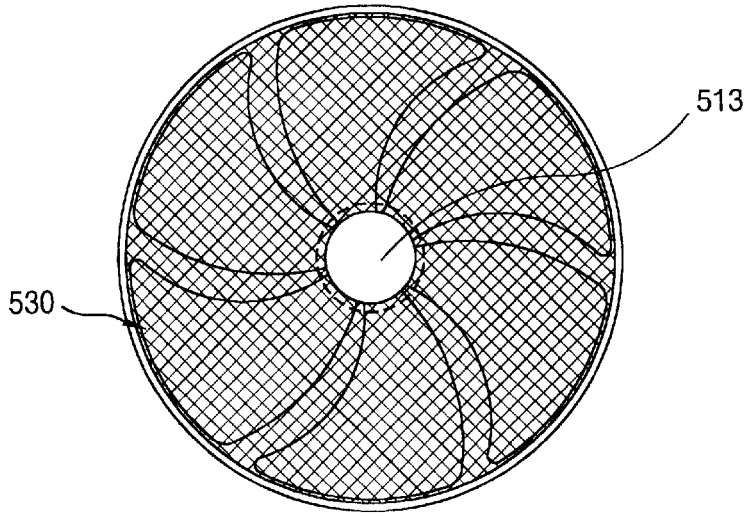
FIG. 8 is a plan view of the fan of FIG. 7 in accordance with the second embodiment of the present invention.

FIG. 7 is a sectional view of a fan having a dust-proof apparatus in accordance with a second embodiment of the present invention, and FIG. 8 is a plan view of the fan of FIG. 7 in accordance with the second embodiment of the present invention.

As shown in FIGS. 7 and 8, a fan having a dust-proof apparatus in accordance with a second embodiment of the present invention includes: a casing 500 having an entrance 520 and a passage (F), a rotation driving unit (M) installed inside the casing 500, a plurality of blades 512 positioned in the passage (F) and coupled at a rotational shaft 511 of the rotation driving unit (M) so as to be rotated, and a dust-proof member 530 installed at an entrance 520 of the passage (F) to cover the entrance 520 of the passage (F), and being rotated together with the blades 512.

The blades 512 are coupled at an outer circumference of a hub 513 connected to the rotational shaft 512.

The dust-proof member 530 includes a mesh portion 531 in a disk type having a size corresponding to the size of the entrance 520 of the passage (F), and an outer circumferential portion 532 extended and bent from the marginal portion of the disk type mesh portion 531.

A coupling portion 533 is formed at a central portion of the disk type mesh portion 531. The coupling portion 533 is inserted to be fixed at the end of the hub.

In case of coupling the coupling portion 533 of the dust-proof member 530 to the end of the hub 513, an additional engaging unit, that is, a screw or a bolt and nut can be used to engage them.

The operation of the fan having a dust-proof apparatus in accordance with the second embodiment of the present invention will now be described.

First, when the rotation driving unit (M) is driven as a power is applied to the rotation driving unit (M), the driving force of the rotation driving unit (M) is transferred to the hub 513 connected to the rotational shaft 511, so that the blades 512 coupled to the hub 513 are also rotated.

As the blades 512 are rotated, the dust-proof member 530 coupled to the hub 513 is accordingly rotated.

According to the rotation of the blades 512, an external air is introduced through the entrance 520 and flows through the passage (F) formed inside the casing 500, and at this time, since the dust-proof member 520 is also rotated, insects or big dusts introduced into the entrance according to the air flowing collide with the dust-proof member 530 and slip out off therefrom, they are prevented from being introduced into the passage (F).

In the fan having the dust-proof apparatus, the mesh portion of the dust-proof member has almost the same size as that of the entrance, and the outer circumferential portion of the dust-proof member can be rotatably supported by the casing according to a separate structure so that the dust-proof member can be smoothly rotated.

Figure 9A:
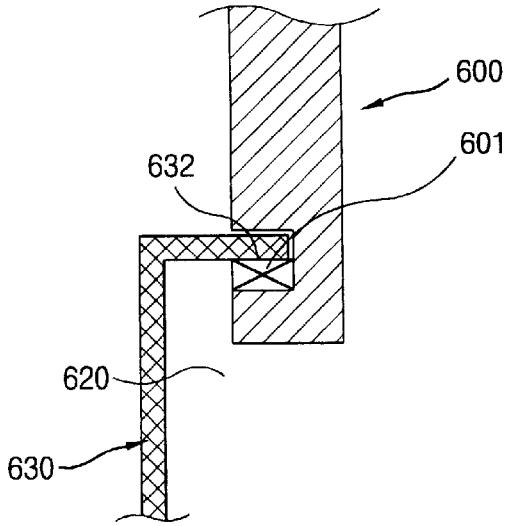
FIGS. 9A and 9B show modifications of the fan having a dust-proof apparatus of FIGS. 5 and 7 in accordance with the present invention.
Figure 9B:
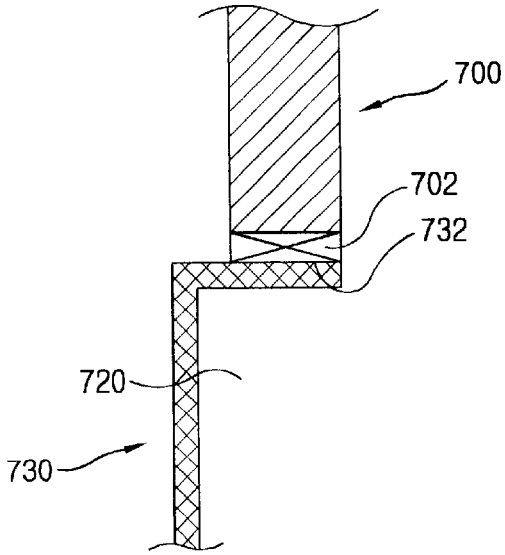

FIGS. 9A and 9B show modifications of the fan having a dust-proof apparatus of FIGS. 5 and 7 in accordance with the present invention.

Referring to the fan having the dust-proof apparatus in accordance with the first and the second embodiments of the present invention, an annular recess 601 can be formed at an entrance 620 of the passage so as to receive the outer circumferential portion 632 of the dust-proof member 630.

Preferably, a bearing is installed in the recess 601 or between the recess and the dust-proof member 630, so that the dust-proof member can be smoothly rotated without being shaken.

If the annular recess 610 is formed and the outer circumferential portion 632 of the dust-proof member 630 is coupled thereto, when insects or big dusts comes off to the outer circumferential portion 632 of the dust-proof member 630 according to the rotation of the dust-proof member 630, they are bound to fly toward the outer wall of the casing 600. Thus, the fan can be more effectively protected against insects or big dusts.

With respect to the fan having a dust-proof apparatus in accordance with the first and the second embodiments of the present invention, as shown in FIG. 9B, a bearing member 702 may be formed between an outer circumferential portion 732 of a dust-proof member 730 and an inner circumferential surface of an entrance 720, so as to prevent a friction or abrasion between the outer circumferential portion of the dust-proof apparatus and the internal surface of the entrance.

In the fan having a dust-proof apparatus in accordance with the present invention, in order to accomplish a better dust-proof effect, the mesh portion of the dust-proof member can be variably modified in its form.

FIGS. 10A, 10B, 10C and 10D show modifications of dust-proof in accordance with the present invention.

Figure 10A:
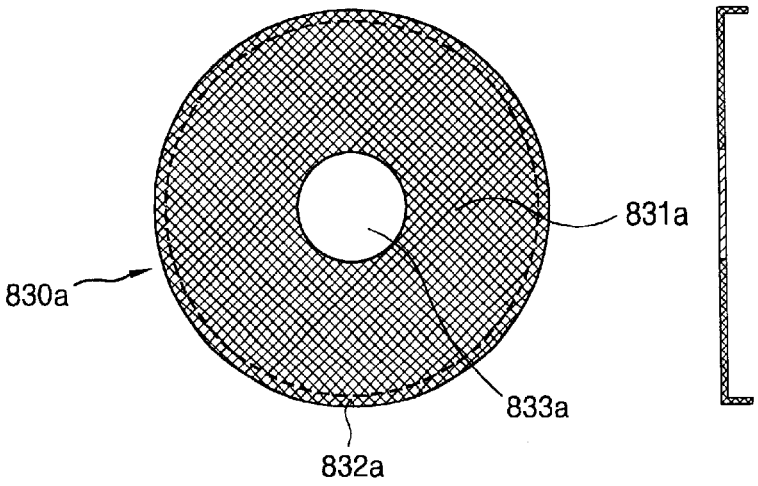
FIGS. 10A, 10B, 10C and 10D show modifications of dust-proof in accordance with the present invention.

With respect to the fan having the dust-proof apparatus in accordance with the first and the second embodiments of the present invention, as shown in FIG. 10A, a mesh portion 831*a* of a dust-proof member 830*a* includes a blocking portion 833*a* formed at a central portion thereof to prevent passing of a fluid such as air.

When the dust-proof member 830*a* is rotated, a centrifugal force is not strong at the central portion. Thus, by forming the blocking portion 833*a* at the central portion, a dust-proof effect can be heightened.

In addition, since the mass of the dust-proof member 830*a* is concentrated to the center due to the blocking portion 833*a*, the dust-proof member 830*a* can be more stably rotated, and the hub can be extended to be fixedly coupled along with the blocking portion 833*a*.

Figure 10B:
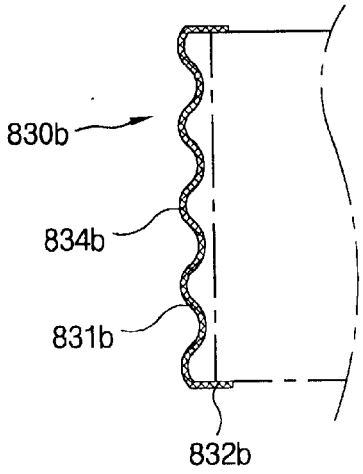

In the fan having the dust-proof apparatus in accordance with the first and the second embodiments of the present invention, as shown in FIG. 10B, a mesh portion 831*b* of the dust-proof member 830*b* may have a plurality of protrusions 843*b* formed at a surface thereof.

The plurality of protrusions 834*b* formed at the surface of the mesh portion 830*b* can more effectively collide with insects or big dusts when the dust-proof member 830*b* is rotated, thereby heightening a dust-proof effect.

Figure 10C:
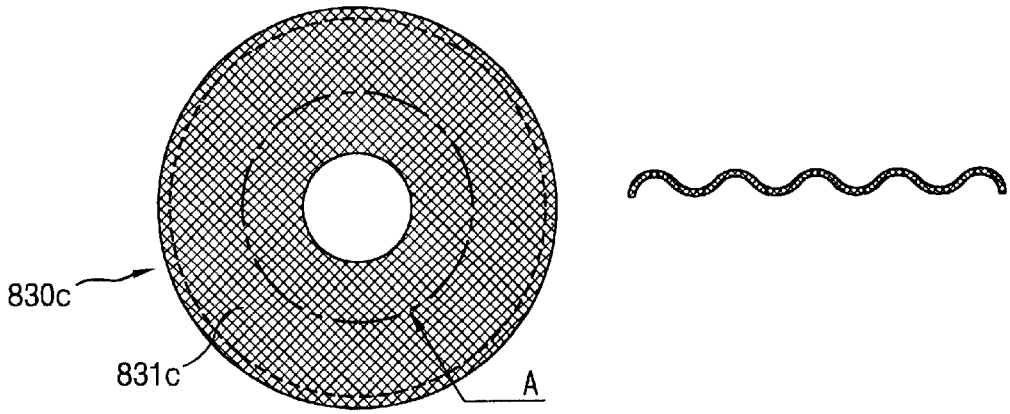

With reference to FIG. 10C, a mesh portion 831*c* of a dust-proof member 830*c* may have a wave form in its section in a circumferential direction.

Thanks to the wave form structure formed on the surface of the mesh portion 831*c*, insects or big dusts can effectively collide therewith when the dust-proof member 830*c* is rotated, thereby heightening a dust-proof effect.

Figure 10D:
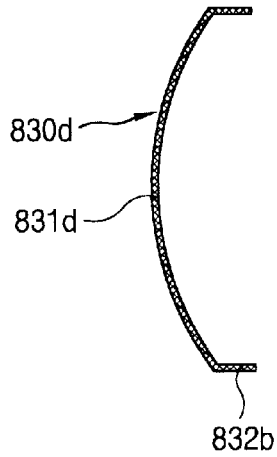

With reference to FIG. 10D, a mesh portion 831*d* of a dust-proof member 830*d* may have a concave surface, not a plane surface, toward an outer side of the casing.

Figure 11:
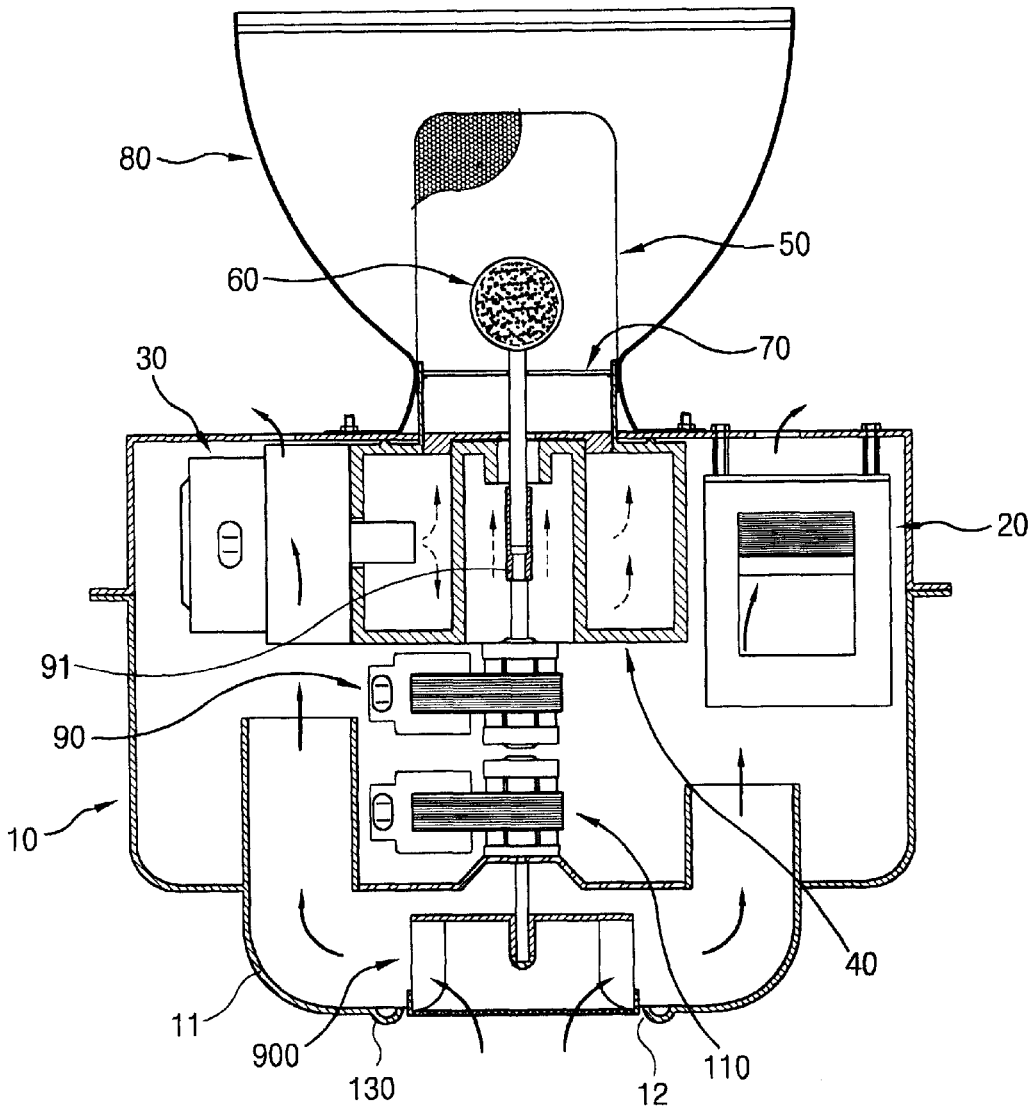
FIG. 11 is a sectional view of an electrodeless lighting system having a fan provided with a dust-proof apparatus in accordance with the present invention.

FIG. 11 is a sectional view of an electrodeless lighting system having a fan provided with a dust-proof apparatus in accordance with the present invention.

The fan having the dust-proof apparatus in accordance with the present invention can be employed to an electrodeless lighting system as shown in FIG. 11.

That is, as shown in FIG. 11, a high voltage generator 20 for generating a high voltage is mounted inside the casing 10, and a microwave generator 30 for receiving the high voltage generated from the high voltage generator 20 and generating a microwave is mounted at the inner side of the casing 10 with a certain space from the high voltage generator 20.

A wave guide 40 for guiding the microwave generated from the microwave generator 30 and serving as a vacuum is mounted between the microwave generator 30 and the high voltage generator 20.

An electrodeless lamp 60 is coupled to be protruded outwardly of the casing 10 so as for the resonator 50 for exciting the microwave transmitted to the waveguide 40 and generating a strong electric field to communicate with the waveguide 40. The electrodeless lamp 60 filled with a substance forming plasma is positioned inside the resonator 50.

A lamp driving motor 90 for rotating the electrodeless lamp 60 and a connection shaft 91 for connecting the lamp driving motor 90 and the electrodeless lamp 60 are provided inside the casing 10.

A passage 11 for guiding air introduced from outside toward the high voltage generator 20 and the microwave generator 30 is provided at one side of the casing 10, and a fan driving motor 110 for generating an air flowing is mounted at the passage 11.

A fan 900 is positioned at an air entrance 12 of the passage 11 and coupled to the fan driving motor 110.

And a dust-proof member 140 having a certain shape is fixedly coupled to the fan 900.

As the fan 900, the fan having a dust-proof apparatus in accordance with the present invention is used.

Especially, if the electrodeless lighting system is installed outside, flying life, that is, a moth, a mosquito gathering to the lighting system or big foreign substances are bound to come off after colliding with the dust-proof member 140 being rotated and provided in the fan 900 in the process that they are being introduced to the air entrance 12 according to air flowing, so that they are prevented from being introduced into the passage 11 and parts can be prevented from damaging due to the foreign substances.

In addition, since the dust-proof member 140 is fixed to the fan 900, when the fan 900 is rotated, the dust-proof member 140 is also rotated together with the van 900. Thus, an eccentricity can be minimized, and since the contact area is wide, the coupling state is ensured firm.

As so far described, the fan having the dust-proof apparatus in accordance with the present invention has many advantages.

That is, for example, since insects or big dusts can be prevented from being introduced according to an air flowing generated as the blades are rotated, and the coupling state between parts is firm. In addition, since the eccentricity is minimized, the parts are not damaged, and as a noise generation is restrained, so that reliability can be heightened.

In addition, the fan having the dust-proof apparatus of the present invention can be adopted to an air-conditioner, a microwave oven or a computer to prevent a foreign substance from being introduced thereinto.

That is, in case of the air-conditioner, the fan having the dust-proof apparatus of the present invention can be provided in outer equipment and inner equipment constituting the air-conditioner, so as to prevent a foreign substance from being introduced to the inside. In case of the computer, the fan having the dust-proof apparatus of the present invention can be adopted to cool the CPU of the computer, so as to prevent a foreign substance from being introduced into the computer.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A fan having a dust-proof apparatus comprising:

a casing having a passage;

a rotation driving unit positioned inside the casing;

a plurality of blades positioned in the passage and coupled to a rotational shaft of the rotation driving unit so as to be rotated; and a dust-proof member installed at an entrance of the passage, and directly and integrally fixed to the blades so as to be rotated together with the blades for preventing insects or dust from entering into the casing.

2. The fan of claim 1, wherein the dust-proof member includes a blocking portion formed at a central portion thereof to block passing of a fluid.

3. The fan of claim 1, wherein a plurality of protrusions are formed at the surface of the dust-proof member.

4. The fan of claim 1, wherein a wave form is formed in a circumferential direction at the surface of the dust-proof member.

5. The fan of claim 1, wherein the dust-proof member has a cylindrical form.

6. A fan having a dust-proof apparatus comprising:

a casing having an entrance and a passage;

a rotation driving unit positioned inside the casing;

a plurality of blades positioned in the passage and coupled to a rotational shaft of the rotation driving unit so as to be rotated; and a dust-proof member installed at an entrance of the passage, and directly and integrally coupled to a hub connected to the rotational shaft so as to be rotated together with the blades for preventing insects or dust from entering into the casing, wherein an outer circumferential portion of the dust-proof member is supported by the entrance so that the dust-proof member is rotatable.

7. The fan of claim 6, wherein the dust-proof member includes a blocking portion formed at a central portion thereof to block passing of fluid.

8. The fan of claim 6, wherein a plurality of protrusions are formed at the surface of the dust-proof member.

9. The fan of claim 6, wherein a section of the dust-proof member sectioned in a circumferential direction has wavelike-shape.

10. The fan of claim 6, wherein the dust-proof member has a cylindrical form.

11. The fan of claim 6, wherein the casing is formed with an annular recess at a circumferential surface of the entrance, into which the outer circumferential portion of the dust-proof member is inserted so as to be rotatably supported.

12. An electrodeless lighting system having a fan with a dust-proof apparatus comprising:

a casing;

a microwave generator mounted inside the casing and generating microwave energy;

a wave guide for guiding the microwave energy generated from the microwave generator and serving as a first resonator;

a second resonator installed outside the casing so as to communicate with the waveguide, and exciting the microwave energy guided through the waveguide to generate a strong electric field; and an electrodeless lamp mounted inside the second resonator and forming a plasma as gas filled therein is excited by the strong electric field of the second resonator, to thereby generate light, wherein the fan having a dust-proof apparatus comprises:

a passage formed at the casing to suck external air to cool the electrodeless lighting system;

a rotation driving unit installed inside the casing;

a plurality of blades installed in the passage and coupled to a rotational shaft of the rotation driving unit so as to be rotated; and a dust-proof member installed at an entrance of the passage, and directly and integrally fixed to the blades to be rotated together with the blades for preventing insects or dust from entering into the casing.

* * * * *